United States Patent [19]

Deluty

[11] 3,995,853

[45] Dec. 7, 1976

[54] EXERCISING DEVICE

[76] Inventor: Michael E. Deluty, 37 Addington Road, Brookline, Mass. 02146

[22] Filed: May 21, 1975

[21] Appl. No.: 579,704

Related U.S. Application Data

[63] Continuation-in-part of Ser. No. 481,907, June 21, 1974, Pat. No. 3,885,789.

[52] U.S. Cl. ..... 272/132; 272/140; 272/138

[51] Int. Cl.[2] ..... A63B 21/22

[58] Field of Search ..... 272/83 R, DIG. 3, 138, 272/83, 132, 140

[56] References Cited

UNITED STATES PATENTS

| | | | |
|---|---|---|---|
| 518,967 | 5/1894 | Poole | 272/83 A |
| 1,650,417 | 11/1927 | Benniger | 272/83 A |
| 1,909,461 | 5/1933 | Costa | 272/83 A |
| 3,544,105 | 12/1970 | Latta | 272/83 A |

*Primary Examiner*—Richard C. Pinkham
*Assistant Examiner*—William R. Browne
*Attorney, Agent, or Firm*—Thompson, Birch, Gauthier & Samuels

[57] ABSTRACT

The exercising device has a housing which is attached to a stationary surface. A cord which has a hand grip on its free end can be pulled out of the housing against the adjustable internal resistance of the exercising device. The amount of internal resistance can be varied by means of a control knob. A spring-powered cord retractor reel rewinds the cord back into the housing when the cord is released. The internal resistance is quantitatively adjusted by a friction brake mechanism including a fixed annular brake shoe, a rotatable annular brake disk, and a mechanism for continuously clamping the brake shoe against the brake disk. An automatic mechanism is provided to lock the brake disk to the cord retractor reel as the cord is pulled out of the housing, and to unlock the brake disk from the cord retractor reel as the cord is rewound into the housing. Optionally, the cord is passed around a guide roller which can be selectively immobilized as the cord is pulled out of the housing so that the guide roller acts as a capstan.

7 Claims, 4 Drawing Figures

EXERCISING DEVICE

CROSS-REFERENCE TO RELATED APPLICATION

This application is a continuation-in-part of application Ser. No. 481,907, filed June 21, 1974, which issued as U.S. Pat. No. 3,885,789 on May 27, 1975.

BACKGROUND OF THE INVENTION

Previous exercising devices of this type have usually taken the form of complex mechanisms, or have taken the form of simple mechanisms employing friction brakes acting directly on the pull cord. The complex mechanisms are relatively expensive to construct. The simple mechanisms wear out the cord when high friction force loads are applied against the cord.

Accordingly, it is an object of this invention to provide an exercising device which is a simple mechanism, which is inexpensive to construct, and which does not apply a friction brake against the pull cord.

A further object of this invention is to provide an exercising device on which the operator can manually select a variety of specific pull cord resistance force levels.

A still further object of this invention is to provide an exercising device which the operator can utilize in a true exercising motion as if he were lifting a barbell or a dumbbell.

SUMMARY OF THE INVENTION

The exercising device comprising the preferred embodiment of this invention has a hollow housing in which a rotatably mounted cord retractor reel is spring-loaded in the rewind direction. A flexible cord is attached to the retractor reel and extends out of the housing where it is fitted with a hand grip. When little or no pulling force is exerted by the operator on the hand grip, the retractor reel rewinds the cord back into the housing.

When the operator pulls on the hand grip, the outward pulling force on the cord is resisted by a combination of three mechanisms mounted within the housing. All of these mechanisms can be adjusted to produce various levels of resistance. The first resisting mechanism is the cord retractor reel which continuously produces a small biasing force on the cord in the rewind direction. This force can be adjusted by tightening or loosening the retractor reel spring. The other two mechanisms which resist the outward pull of the cord both operate only when the cord is being pulled out of the housing (unwound) by the operator, and both are inoperative when the cord is being rewound back into the housing by the retractor reel.

The second resisting mechanism is a manually adjustable variable resistance friction brake means which acts through automatic locking means to brake the cord retractor reel as the cord is pulled out of the housing. The friction brake means includes a fixed annular brake shoe, a rotatable annular brake disk, and means for clamping the brake shoe against the brake disk. Automatic means is provided for locking the brake disk to the cord retractor reel as the cord is pulled out of the housing and for unlocking the brake disk from the retractor reel as the cord is rewound into the housing.

After the cord passes from the retractor reel, it is led to and is passed preferably one full turn around the third resisting mechanism, which takes the form of a capstan, and the cord is then led out of the housing.

The capstan can be manually locked in a stationary position to oppose the cord's being pulled out of the housing. However, if the third force is not desired, the capstan can be unlocked and permitted to freewheel as the cord is pulled out of the housing. In both modes, the capstan is permitted to freewheel in the rewind direction. The stationary capstan cannot operate effectively on the cord unless the cord around the capstan is pulled tightly in both directions. Therefore, the friction brake means has the additional function of causing a drag on the cord on the rewind side of the capstan. In this manner, the friction brake means acts in direct opposition to the outward manual pull on the cord and also causes the capstan to frictionally resist the outward pull on the cord.

At all times, the retractor reel urges the cord in the rewind direction while the friction brake means and the capstan are inoperative as the cord rewinds. At all times, the friction brake means applies a brake on the cord retractor reel to resist the pull of the cord out of the housing. At operator-selected times, the capstan can be locked into its operative stationary position to cooperate with the friction brake means and the retractor reel so that all three mechanisms combine to resist the cord's being pulled out of the housing by the operator.

DESCRIPTION OF THE PREFERRED EMBODIMENT

Figure 1:
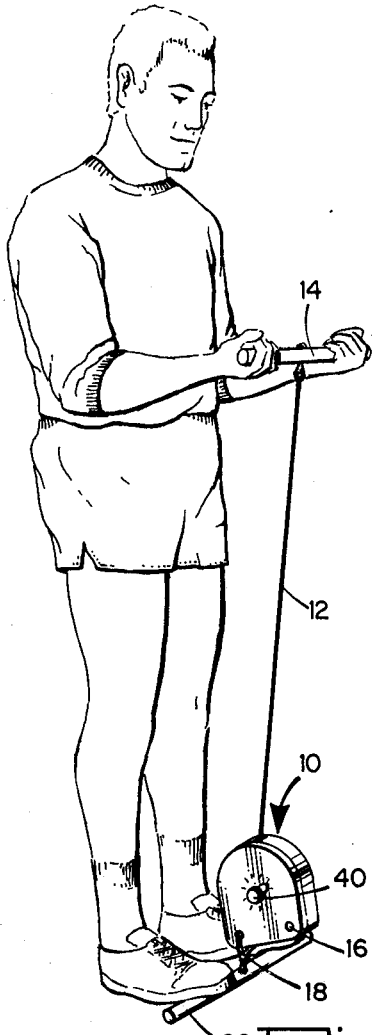
FIG. 1 is a perspective view of the exercising device of the preferred embodiment of this invention showing an operator holding the hand grip and pulling the cord out of the housing.

FIG. 1 shows a human operator performing a curling exercise with the exercising device 10 of this invention. The curling exercise is usually performed with a barbell and it is the purpose of FIG. 1 to show one example of how exercising device 10 can be substituted for a barbell in weight training. The operator simply dials the desired "weight" setting on the device and then uses the exercising device as if it were a barbell weighing the dialed amount.

Exercising device 10 is provided with a flexible pull cord 12, preferably made of nylon, and a detachable hand grip 14. Various different types of hand or other grips can be attached to the end of cord 12 in order to meet the requirements of various exercise routines. Examples of different grips include double grips, bar grips, loop grips, grips to fit the operator's head, and grips to fit the operator's feet. The exercising device of this invention is not limited to any specific type of grip attached to the end of pull cord 12.

In order to hold the exercising device 10 in a stationary position (which is usually preferred), the exercising device may be provided with various fittings or apertures, such as apertures 16 through which a short length of line 18 can be looped. Line 18 can then be attached to a foot rest 20, or to a wall fitting, or to a ceiling fitting, or to other fixed supports. It will be understood that a wide variety of such fittings is contemplated and this invention is not limited to any specific type or location of fitting, or any specific type or location of line, or any specific type or location of foot rest or other fixed support.

Figure 2:
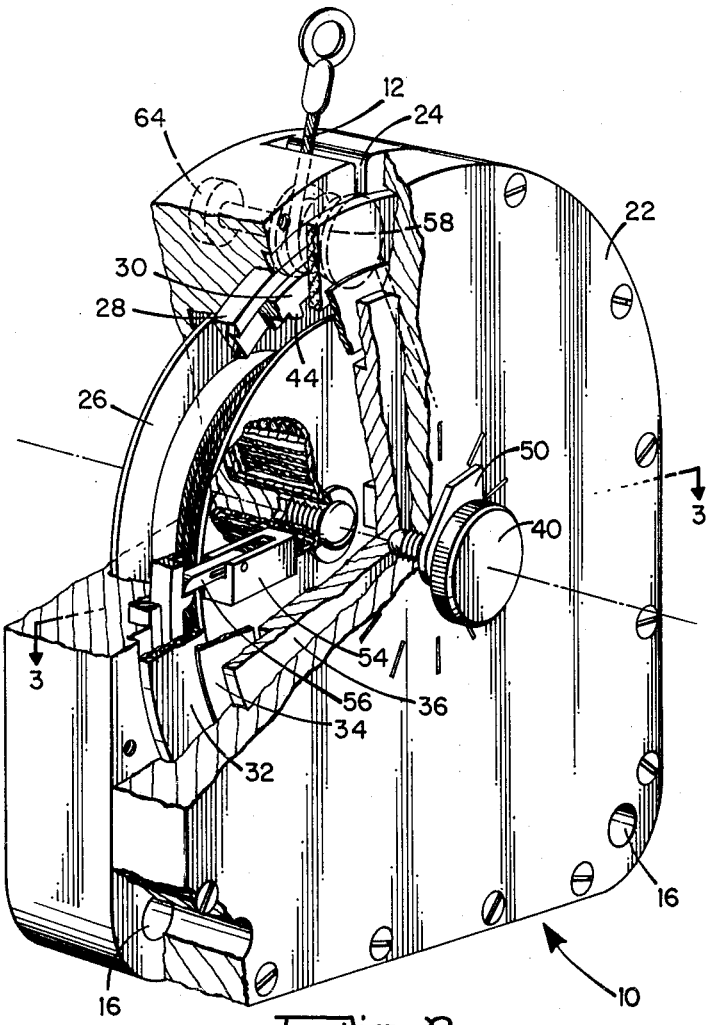
FIG. 2 is a perspective view of the exercising device of FIG. 1 showing the housing and various interior elements broken away.
Figure 4:
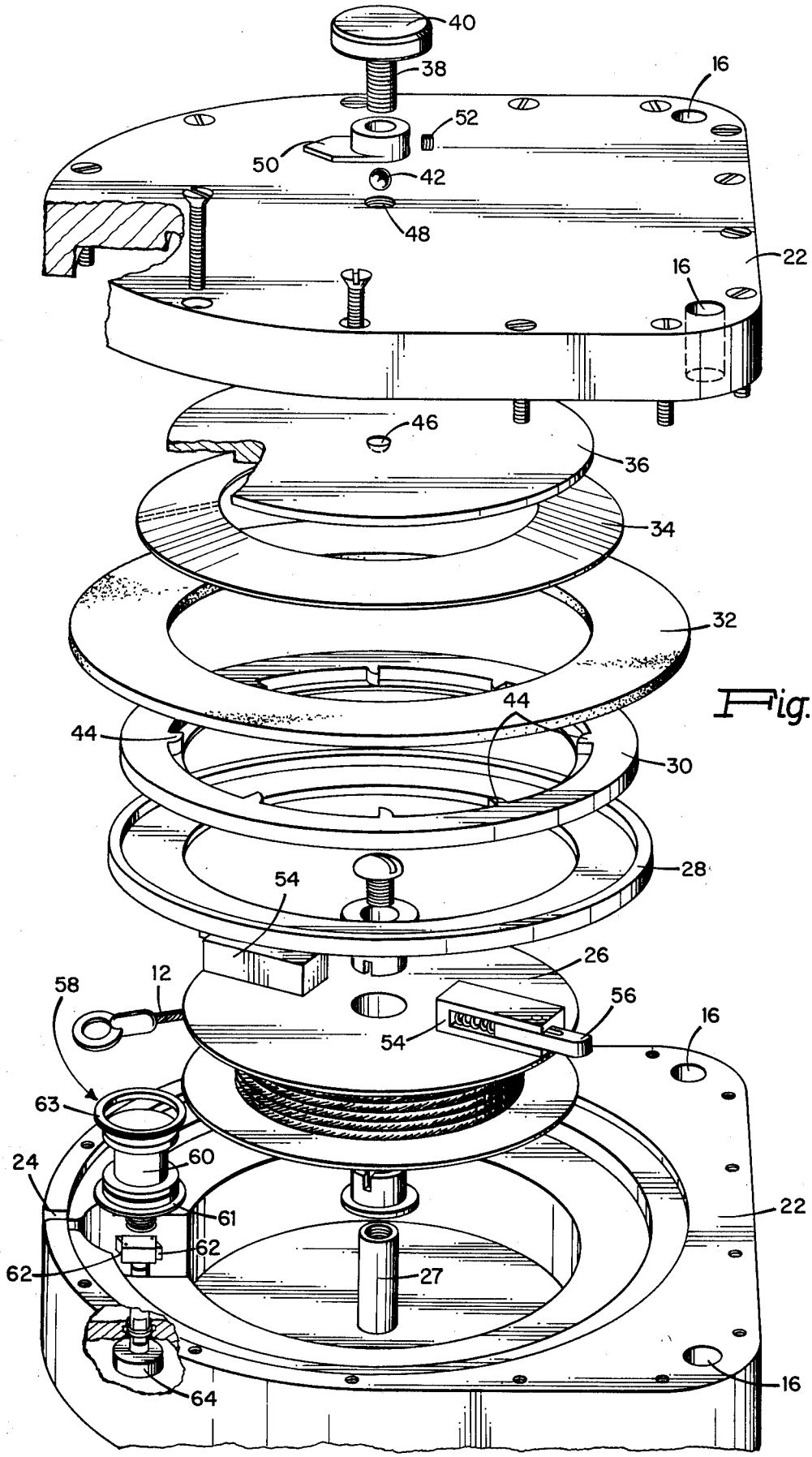
FIG. 4 is an exploded view of the exercising device of FIGS. 2 and 3 showing details of the interior elements.

Referring now to FIGS. 2 and 4, it will be seen that the exercising device 10 has a hollow two part housing 22 which is bolted together and which has a cord opening 24 through which pull cord 12 extends. The outer end of cord 12 is fitted with hand grip 14 and the inner end of cord 12 is fixed to and is wrapped several times around retractor reel 26. Retractor reel 26 is rotatably mounted in the housing on shaft 27 and is spring-powered in the clockwise or rewind direction. Preferably, retractor reel 26 exerts a continuous rewind force on the cord of approximately 1 to 3 lbs. This force level can be adjusted by modifying the spring tension. Thus, whenever the operator releases hand grip 14, or exerts less than the retractor reel rewind force, cord 12 will be drawn into housing 22 through opening 24 and will be rewound on reel 26. The size of hand grip 14 prevents the outer end of cord 12 from being drawn entirely into housing 22 through opening 24.

In order to provide a substantial force which will resist the operator's outward pull on the cord, a manually adjustable variable resistance friction brake means is mounted within the housing for cooperation with the cord retractor reel 26. The friction brake means acts through automatic locking means to brake the retractor reel when the cord is pulled out of the housing and to release the retractor reel to permit the cord to be pulled back into the housing.

Figure 3:
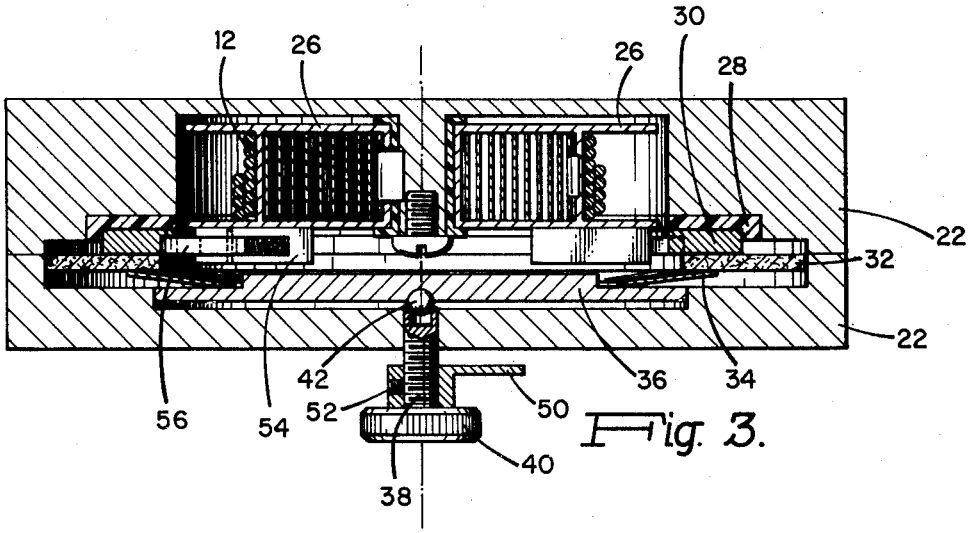
FIG. 3 is a section taken along line 3—3 on FIG. 2.

As clearly shown in FIGS. 3 and 4, the friction brake means includes an annular bearing 28 which is fixed within the larger or back side of the housing; an annular brake disk 30 which rotates within bearing 28; an annular brake shoe 32 which is fixed against rotation within the smaller or front side of the housing; an annular spring 34 which is pressed against brake shoe 32; a circular pressure plate 36 which is pressed against spring 34; and a bolt 38 which has a large easily manipulated bolt head 40 on its trailing end and which has a ball bearing 42 mounted on its leading end. The bolt is screwed through the front side of housing 22 and engages against pressure plate 36 to clamp elements 28, 30, 32, 34 and 36 together.

In greater detail, bearing 28 is preferably made of oilless bearing material and is keyed to the back side of the housing to prevent rotation thereof. Brake disk 30, which is preferably smooth steel on all of its surfaces, has centrally extending teeth 44 which engage with the automatic locking means in a manner which will be described subsequently. Brake shoe 32 has brake lining or other abrasive material affixed to its back surface which faces brake disk 30. Alternatively, brake disc 30 could have the brake lining material affixed to its front surface and brake shoe 32 could have the smooth metal back surface. Brake shoe 32 is keyed to the front side of the housing to prevent its rotation. The brake lining material can be affixed to brake shoe 32 in a replaceable manner or permanently.

In order to continuously press the keyed brake shoe 32 against the rotating brake disk 30, a belleville spring 34 is positioned against the front side of brake shoe 32. Of course, other types of resilient elements could be substituted for the belleville spring. A circular pressure plate 36 is positioned to bear against the front side of spring 34. The pressure plate preferably has a small depression 46 at its center on the front side and the plate has a reduced diameter portion on its back side which extends into the annular opening of the spring 34.

Bolt 38 is screwed through threaded hole 48 in the front side of the housing and carries a poundage indicating arrow 50 which is fixed to the bolt shaft by a set screw 52. The poundage indicating arrow 50 turns with bolt 38 across dial markings on the housing and indicates the level of resisting force being applied against the cord.

The bolt mounts a ball bearing 42 at its leading end which is seated within depression 46 in pressure plate 36. Thus, it will be appreciated that the friction brake means is set up and adjusted to its desired friction brake force level by turning bolt head 40 until the poundage indicating arrow 50 is aligned with the desired force level marking on the front of the housing. This causes bolt 38 to press against pressure plate 36 which presses against spring 34 which presses against brake shoe 32 which presses against brake disk 30 which presses against bearing 28 which is seated in the back side of housing 22. This stack of elements comprises the friction brake means.

When the cord is being rewound into the housing by the retractor reel, the friction brake means is not engaged and does not move at all. However, when the cord is pulled out of the housing, the friction brake means is engaged by the automatic locking means which is mounted on the circular front side of the retractor reel 26.

Specifically, the automatic locking means is a ratchet mechanism employing two identical pawl housings 54 and two radially extending spring-loaded engaging pawls 56. The pawls ride over the brake disk teeth 44 when the reel rewinds, and the pawls engage teeth 44 when the reel is unwound. Thus, when the cord is pulled out of the housing 22, the revolving reel is locked to the brake disk 30 which revolves while in frictional contact with fixed brake shoe 32. This frictional braking exerts drag on the cord. Obviously, the more tightly brake shoe 32 is clamped against brake disk 30 the greater the braking action on the retractor reel and the greater the drag on the cord. In contrast, when the cord is rewound, the pawls, because of their shape, reciprocate in their housings 54 and do not cause brake disk 30 to revolve at all. It will be seen that this ratchet mechanism operates automatically to engage or disengage the friction brake mechanism with relation to the retractor reel 26.

An optional cord resistance force is provided by the capstan which is generally indicated as 58. The capstan has an inoperative mode in which its freewheels in both directions and an operative mode in which it is stationary in the unwind direction and freewheels in the rewind direction. Capstan 58 has a flanged shaft 60 which is fixed to an underlying flanged bearing 61 which in turn is rotatably secured in the back side of housing 22 by a retaining ring 63. By means of engaging pawls 62 and as unshown inwardly toothed ring mounted within the lower interior of the capstan shaft 60, the capstan can be set in its operative ratcheting mode or in its inoperative freewheeling mode. A control button 64 is mounted in the back side of the housing and is of the type which when depressed once stays depressed and which when depressed again springs back to its original position. In this optional embodiment, when control button 64 is depressed once, the ratcheting mechanism (including pawls 62) is inserted into the capstan shaft interior where it aligns with the beveled toothed ring which is fixed to the interior of the capstan shaft. In this operative mode, the capstan freewheels in the rewind direction and is locked against rotation in the unwind direction. When control button 64 is depressed again, the ratcheting mechanism is retracted from within the capstan interior thereby permitting the capstan to freewheel in both directions.

When the optional capstan embodiment is employed, the cord is run from the retractor reel to the capstan around which it is wrapped preferably one full turn. The cord is then run out of housing cord opening 24 which has smooth curved walls. When the optional capstan is omitted, it is either replaced by a conventional guide roller or it is omitted entirely. A guide roller facilitates somewhat smoother functioning and decreases friction on the cord.

The reason that the capstan is included in the optional embodiment is that the capstan multiplies the resistance force opposing the unwinding of the cord. Obviously, many factors will affect the exact multiplying ratio produced by the capstan. Examples of these factors include the diameter of the capstan, the capstan surface roughness, the diameter of the cord, the cord material, the number of turns on the capstan, and numerous others. However, regardless of the exact multiplying ratio, the capstan will produce a substantial resistance force opposing the passage of the cord out of the housing.

Although the capstan has been described as preferably having a ratchet operative mode, it alternatively could have an entirely stationary operative mode, i.e. one in which the capstan is stationary in both the unwind and rewind directions. This is functionally possible because a capstan cannot provide significant frictional resistance against the cord unless the cord is pulled tightly around the capstan shaft from both directions. For this reason, when the operator releases the hand grip (or ceases to pull on it), there is no outward force on the cord. Thus, the cord simply slips on the stationary capstan shaft, and the small rewind force of retractor reel 26 is sufficient to rewind the cord onto the reel.

In order to use the exercising device of this invention, the operator first determines the force level to be applied against the cord by the device. If it is a relatively low force level, he sets the capstan in the inoperative mode by depressing control button 64 to retract ratcheting mechanism 62 from within capstan shaft 60. This permits the capstan to freewheel in both directions. If it is a relatively high force level, he sets the capstan in the operative mode by depressing control button 64 to insert the ratcheting mechanism into the capstan shaft. This locks the capstan in the unwind direction and permits it to freewheel in the rewind direction.

Then, the operator turns bolt head 40 until indicator arrow 50 aligns with the desired figure on the calibrated housing dial. This sets the friction brake means at the tightness level needed to produce the desired braking force opposing the outward pull on the cord. Preferably, the dial has two rings of concentric figures. One ring shows the resistance force levels for the capstan inoperative mode, and the other ring shows the resistance force levels for the capstan operative mode.

The device is anchored to a fixed support and the handle is pulled by the operator away from the housing by using a pulling force exceeding that of the dialed internal resistance force. When the operator reduces his pulling force below that of the retractor reel, the cord smoothly rewinds back into the housing. In this fashion, the operator can exercise slowly or rapidly and can adjust the cord resistance force level quickly and easily.

The above description obviously suggests many possible variations and modifications of this invention which would not depart from its spirit and scope. It should be understood, therefore, that the invention is not limited in its application to the details of structure specifically described or illustrated and that within the scope of the appended claims, it may be practiced otherwise than as specifically described or illustrated.

I claim:

1. An exercising device commprising:

a. a housing having a hollow interior and a cord opening;

b. a cord retractor reel mounted for rotation within said housing;

c. a flexible cord fixed to and wrapped around said retractor reel, said cord running from said reel out of said housing through said cord opening;

d. rewind means for continuously urging said retractor reel in the rewind direction;

e. manually adjustable variable resistance friction brake means mounted within said housing for braking said retractor reel in the unwind direction, said friction brake means including an annular brake disk rotatably mounted within said housing co-axial with said retractor reel, an annular brake shoe fixedly mounted within said housing co-axial with said brake disk and in opposing relation thereto, an abrasive surface provided on the opposing side of said brake disk and/or said brake shoe, and manually adjustable means for continuously pressing said brake shoe against said brake disk;

f. said manually adjustable means for continuously pressing said brake shoe against said brake disk including a resilient element positioned against the non-opposing side of said brake shoe, a pressure plate positioned against said resilient element, a threaded hole formed in said hollow housing adjacent to said pressure plate and in axial alignment with said annular brake shoe, a threaded shaft threadably engaged in said threaded hole, the leading end portion of said shaft engaging said pressure plate, and manually operable means associated with the trailing end portion of said shaft for axially advancing said shaft into said housing to cause said brake shoe to be adjustably pressed against said brake disk;

g. automatic means for locking said retractor reel to said brake disc as said cord is pulled out of said housing in the unwind direction and for unlocking said retractor reel from said brake disk as the cord is retracted into said housing in the rewind direction; and h. said rewind means and said variable resistance friction brake means cooperating to apply a retarding force on said retractor reel to oppose an exteriorly applied manual force pulling said cord in the unwind direction, and said rewind means applying a rotational force on said retractor reel to pull said cord in the rewind direction in the absence of an exteriorly applied manual force on said cord.

2. The exercising device of claim 1 wherein said retractor reel has a generally cylindrical configuration, said annular brake disk is substantially parallel to the